US008833675B1

(12) United States Patent
Meigs et al.

(10) Patent No.: US 8,833,675 B1
(45) Date of Patent: Sep. 16, 2014

(54) ORBITAL CLEANING ASSEMBLY AND METHOD

(76) Inventors: Richard Meigs, Davis, CA (US); Dana M. Pezzimenti, Williamsville, NY (US); Robert J. Runge, II, Springville, NY (US)

( * ) Notice: Subject to any disclaimer, the term of this patent is extended or adjusted under 35 U.S.C. 154(b) by 217 days.

(21) Appl. No.: 13/291,746

(22) Filed: Nov. 8, 2011

Related U.S. Application Data

(60) Provisional application No. 61/411,197, filed on Nov. 8, 2010.

(51) Int. Cl.
*B05B 3/02* (2006.01)
*B05B 3/00* (2006.01)

(52) U.S. Cl.
USPC ..... 239/229; 239/263.1; 134/172; 134/180; 134/181

(58) Field of Classification Search
CPC ..... B05B 3/00; B05B 3/02; B05B 3/028; B05B 3/008; B05B 1/06; B05B 13/0627; B08B 3/02; B08B 3/024; B08B 9/0813; B08B 9/093; B08B 9/0936
USPC ..... 239/7, 225.1, 227, 229, 231, 233, 239/263.1, 263.3, 264; 134/167 R, 172, 180, 134/181
See application file for complete search history.

(56) References Cited

U.S. PATENT DOCUMENTS

| | | | | | |
|---|---|---|---|---|---|
| 3,108,749 | A | * | 10/1963 | Drayer et al. | 239/102.1 |
| 3,653,598 | A | * | 4/1972 | Waldrum | 239/229 |
| 4,272,018 | A | * | 6/1981 | Hickson | 239/8 |
| 4,351,478 | A | * | 9/1982 | Looper | 239/227 |
| 4,659,018 | A | * | 4/1987 | Shulman | 239/264 |
| 4,662,565 | A | * | 5/1987 | Waldrum | 239/236 |
| 5,794,854 | A | | 8/1998 | Yie | |
| 7,310,955 | B2 | | 12/2007 | Hume et al. | |
| 7,600,387 | B2 | | 10/2009 | Hume et al. | |
| 2006/0049274 | A1 | | 3/2006 | Hume et al. | |
| 2006/0053165 | A1 | | 3/2006 | Hume et al. | |
| 2008/0092558 | A1 | | 4/2008 | Hume et al. | |
| 2008/0099582 | A1 | | 5/2008 | Hume et al. | |

* cited by examiner

*Primary Examiner* — Darren W Gorman
(74) *Attorney, Agent, or Firm* — Simpson & Simpson, PLLC

(57) ABSTRACT

An orbital cleaning assembly, including: an axis of rotation; a housing; a drive assembly at least partly disposed within a space formed by the housing; a tube assembly at least partly disposed within the space and including a tube including: a first end arranged to connect to a source of fluid and a flexible portion including a second end of the tube. The second end is arranged to receive a nozzle. The drive assembly is arranged to position the second end at a radial distance from the axis of rotation and flex the tube assembly such that the second end traverses a path about the axis.

12 Claims, 7 Drawing Sheets

ORBITAL CLEANING ASSEMBLY AND METHOD

TECHNICAL FIELD

This application claims the benefit under 35 U.S. C. §119 (e) of U.S. Provisional Application No. 61/411,197 filed Nov. 8, 2010, which application is incorporated herein by reference.

The invention broadly relates to a cleaning system and method, more specifically to a liquid nitrogen cleaning system and method, and even more particularly to a liquid nitrogen cleaning system and method with an orbital motion.

BACKGROUND

Liquid nitrogen cleaning systems are known in the art. Examples include U.S. Pat. No. 7,310,955 (Hume et al.) and U.S. Pat. No. 7,600,387 (Hume et al.), and United States Patent Publication Nos. 2006/0053165 (Hume et al.), 2006/0049274 (Hume et al.), 2008/0092558 (Hume et al.), and 2008/0099582 (Hume et al). One problem with these prior art systems is that they include seals that quickly shrink and break under the extremely cold temperatures of liquid nitrogen. Sprayers for other fluids are also known, such as disclosed in U.S. Pat. No. 5,794,854 (Yie).

SUMMARY

According to aspects illustrated herein, there is provided an orbital cleaning assembly, including: an axis of rotation; a housing; a drive assembly at least partly disposed within a space formed by the housing; a tube assembly at least partly disposed within the space and including a tube with: a first end arranged to connect to a source of fluid and a flexible portion including a second end of the tube. The second end is arranged to receive a nozzle. The drive assembly is arranged to position the second end at a radial distance from the axis of rotation and flex the tube assembly such that the second end traverses a path about the axis.

According to aspects illustrated herein, there is provided an orbital cleaning assembly, including: an axis of rotation; a housing; a drive assembly at least partly disposed within the housing and including a motor and a deflector assembly with a through-bore; and a tube assembly at least partly disposed within the housing. The tube assembly includes a tube with a first end arranged to connect to a source of fluid, a flexible portion passing through the through-bore, a second end, and a portion between the second end and the deflector assembly. The second end is arranged to receive a nozzle. The deflector assembly is arranged to position the second end at a radial distance from the axis of rotation. The motor is arranged to rotate the deflector assembly such that the second end traverses a path about the axis. The first end of the tube is rotationally fixed with respect to the axis of rotation. The drive assembly is axially displaceable within the housing such that as the drive assembly displaces toward the first end of the tube, an axial length the portion of the tube increases and flexibility of the portion, in a radially outward direction, increases. The drive assembly is axially displaceable within the housing such that as the drive assembly displaces toward the second end of the tube, the axial length of the portion decreases and the flexibility of the portion decreases.

According to aspects illustrated herein, there is provided a method of dispensing a pressurized fluid, including: connecting a first end of a tube to a source of pressurized fluid; engaging a flexible portion of the tubing with a deflector assembly; positioning a second end of the flexible tube at a radial distance from an axis of rotation using the deflector assembly; rotating the deflector assembly about the axis of rotation such that the second end traverses a path about the axis; and spraying the pressurized fluid from a nozzle attached to the second end.

BRIEF DESCRIPTION OF THE DRAWINGS

Various embodiments are disclosed, by way of example only, with reference to the accompanying schematic drawings in which corresponding reference symbols indicate corresponding parts, in which.

DETAILED DESCRIPTION

At the outset, it should be appreciated that like drawing numbers on different drawing views identify identical, or functionally similar, structural elements of the invention. While the present invention is described with respect to what is presently considered to be the preferred aspects, it is to be understood that the invention as claimed is not limited to the disclosed aspects.

Furthermore, it is understood that this invention is not limited to the particular methodology, materials and modifications described and as such may, of course, vary. It is also understood that the terminology used herein is for the purpose of describing particular aspects only, and is not intended to limit the scope of the present invention, which is limited only by the appended claims.

Unless defined otherwise, all technical and scientific terms used herein have the same meaning as commonly understood to one of ordinary skill in the art to which this invention belongs. Although any methods, devices or materials similar or equivalent to those described herein can be used in the practice or testing of the invention, the preferred methods, devices, and materials are now described.

Figure 1A:
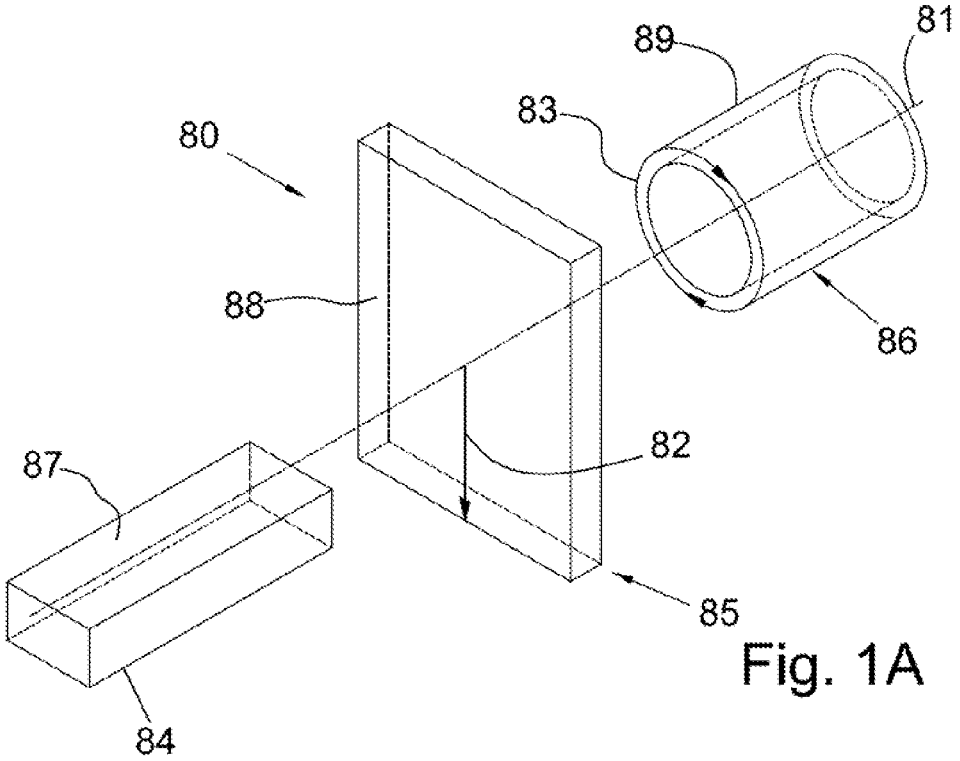
FIG. 1A is a perspective view of a cylindrical coordinate system demonstrating spatial terminology used in the present application.

FIG. 1A is a perspective view of cylindrical coordinate system 80 demonstrating spatial terminology used in the present application. The present invention is at least partially described within the context of a cylindrical coordinate system. System 80 has a longitudinal axis 81, used as the reference for the directional and spatial terms that follow. The adjectives "axial," "radial," and "circumferential" are with respect to an orientation parallel to axis 81, radius 82 (which is orthogonal to axis 81), and circumference 83, respectively. The adjectives "axial," "radial" and "circumferential" also are regarding orientation parallel to respective planes. To clarify the disposition of the various planes, objects 84, 85, and 86 are used. Surface 87 of object 84 forms an axial plane. That is, axis 81 forms a line along the surface. Surface 88 of object 85 forms a radial plane. That is, radius 82 forms a line along the surface. Surface 89 of object 86 forms a circumferential plane. That is, circumference 83 forms a line along the surface. As a further example, axial movement or disposition is parallel to axis 81, radial movement or disposition is parallel to radius 82, and circumferential movement or disposition is parallel to circumference 83. Rotation is with respect to axis 81.

The adverbs "axially," "radially," and "circumferentially" are with respect to an orientation parallel to axis 81, radius 82, or circumference 83, respectively. The adverbs "axially," "radially," and "circumferentially" also are regarding orientation parallel to respective planes.

Figure 1B:
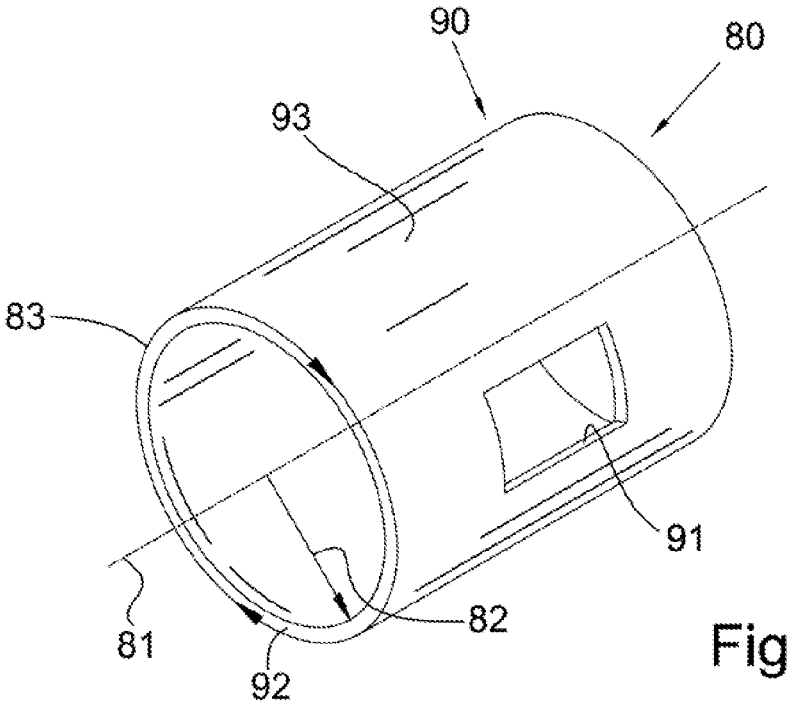
FIG. 1B is a perspective view of an object in the cylindrical coordinate system of FIG. 1A demonstrating spatial terminology used in the present application; and, FIG. 2A is a cross-sectional view of an orbital cleaning assembly in a first configuration.

FIG. 1B is a perspective view of object 90 in cylindrical coordinate system 80 of FIG. 1A demonstrating spatial terminology used in the present application. Cylindrical object 90 is representative of a cylindrical object in a cylindrical coordinate system and is not intended to limit the present invention in any manner. Object 90 includes axial surface 91, radial surface 92, and circumferential surface 93. Surface 91 is part of an axial plane, surface 92 is part of a radial plane, and surface 93 is a circumferential surface.

Figure 2A:
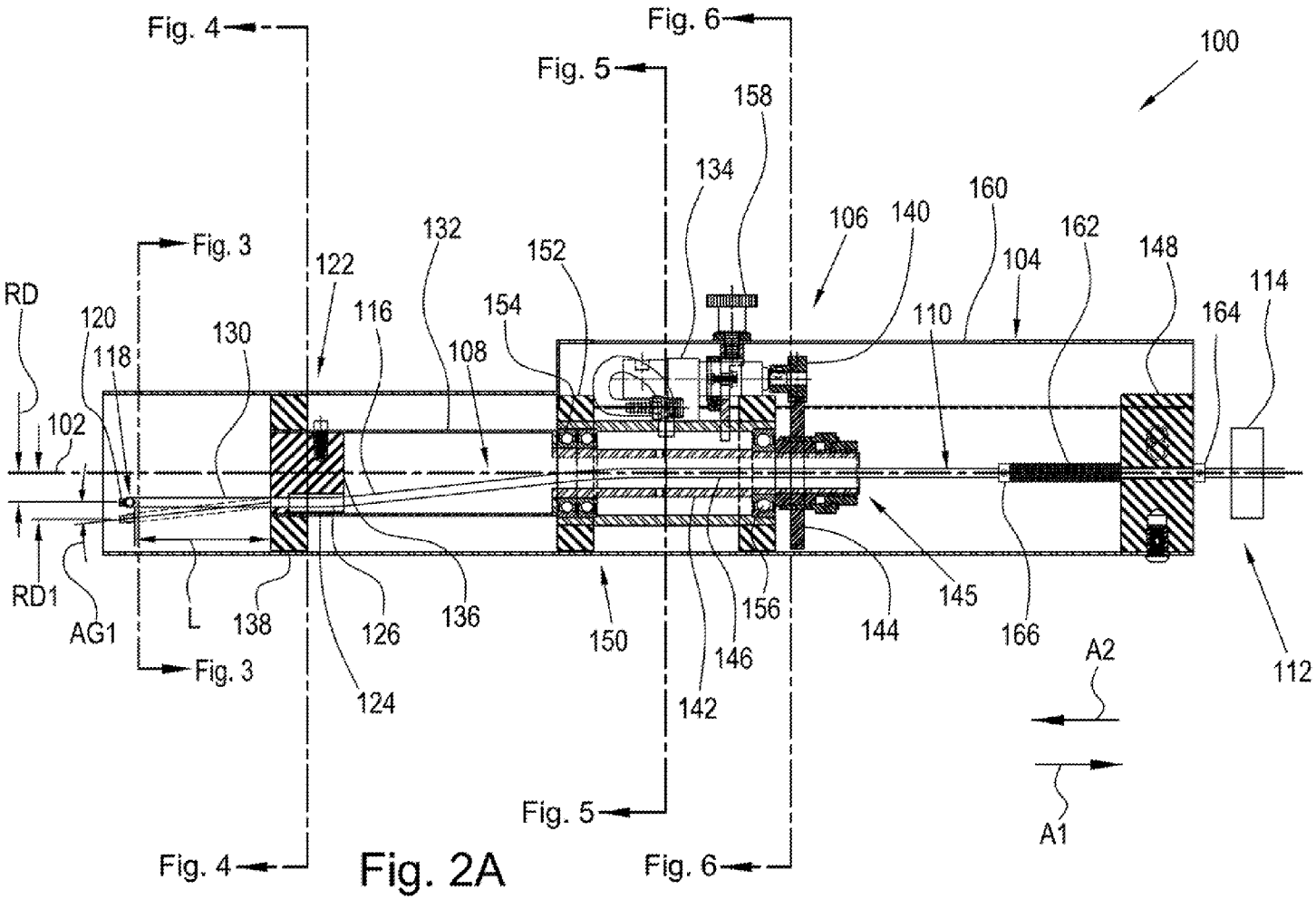
FIG. 2B is a cross-sectional view of an orbital cleaning assembly in a second configuration.

FIG. 2A is a cross-sectional view of orbital cleaning assembly 100 in a first configuration.

Figure 2B:
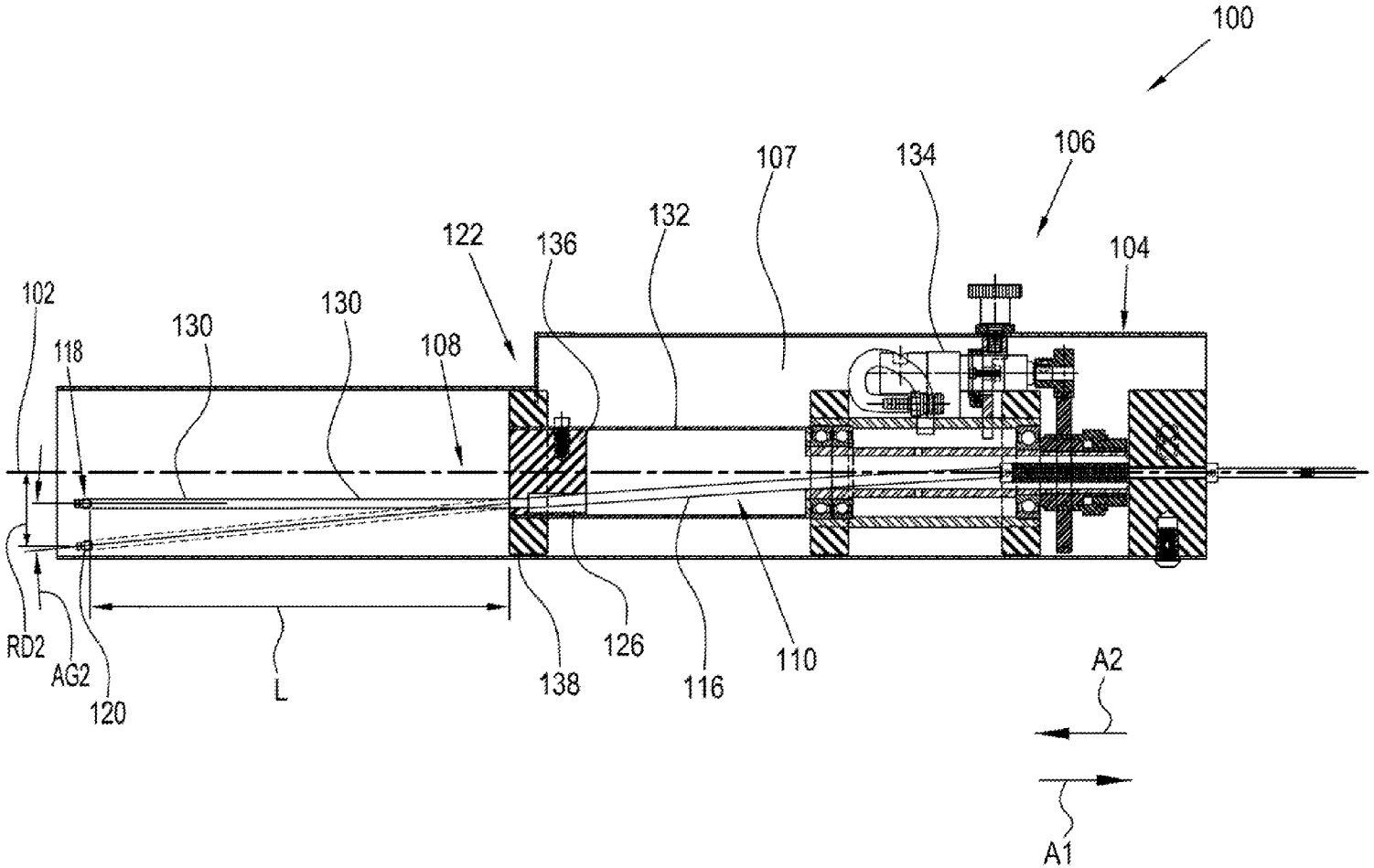

FIG. 2B is a cross-sectional view of orbital cleaning assembly 100 in a second configuration. The following should be viewed in light of FIGS. 2A and 2B. Assembly 100 includes axis of rotation 102, housing 104, drive assembly 106 at least partly disposed within the housing, that is disposed within space 107 formed by the housing, and tube assembly 108 at least partly disposed within the housing. Assembly 108 includes tube 110 with end 112 arranged to connect to source 114 of fluid and flexible portion 116 including end 118 of the tube. End 118 is arranged to receive nozzle 120. The nozzle is arranged to dispense, or spray, the fluid, for example, for cleaning operations.

Figure 3:
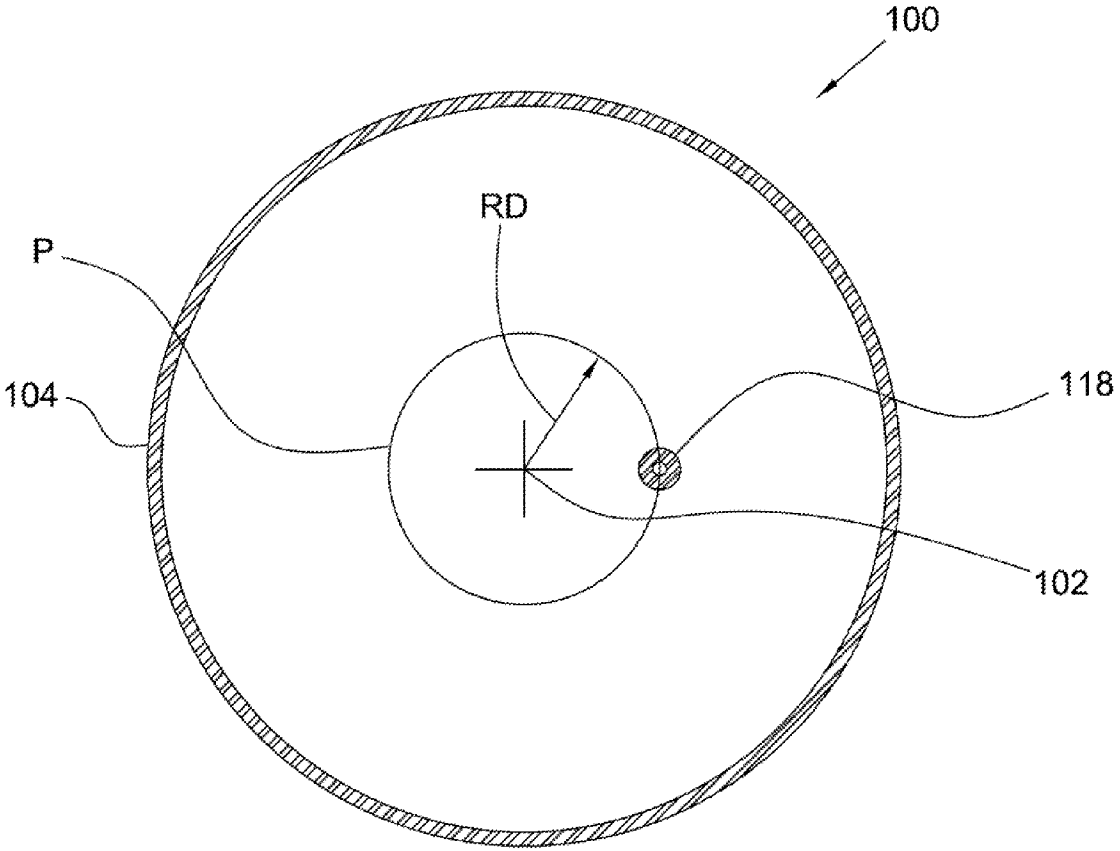
FIG. 3 is a cross-sectional view generally along line 3-3 in FIG. 2A.

FIG. 3 is a cross-sectional view generally along line 3-3 in FIG. 2A. The following should be viewed in light of FIGS. 2A through 3. In an example embodiment, the drive assembly is arranged to position end 118 at radial distance RD from the axis of rotation and to flex the tube assembly such that end 118 traverses path P about the axis. In an example embodiment, P is circular; however, it should be understood that the path can have other shapes. In an example embodiment, the drive assembly includes deflector assembly 122 with through-bore 124 and portion 126 of the tube is disposed within the through-bore. Contact of the tube with the deflector assembly via the through-bore constrains the tube such that end 118 is off-center with respect to the axis of rotation, for example, the deflector assembly constrains the tube such that end 118 is at distance RD.

Portions of tube 110, for example at end 112, are rotationally fixed with respect to axis 102. As further described below, deflector assembly 122 is arranged to rotate about the axis. In doing so, assembly 122 "pulls" portion 130 of tube 110 (axially disposed between assembly 122 and end 118) and end 118 about the axis. As a result, end 118 and the nozzle traverse path P. In an example embodiment, tube 110 is generally unsupported along its length, except at end 148 and by assembly 122.

In an example embodiment, the drive assembly is axially displaceable within the housing. As the drive assembly axially displaces in direction A1, toward end 112 of tube 110, length L for portion 130 of tube 110 increases. As a result, the flexion of portion 130 increases, for example, portion 130 is more flexible. By flexible or flexion, we mean the radially outward displacement of portion 130, in response to centrifugal force from the rotation of assembly 122, from the position shown in FIGS. 2A and 2B, as tube 110 is flexed, or "pulled" about the axis by assembly 122. As the drive assembly axially displaces in direction A2 toward end 118 of tube 110, length L for portion 130 decreases. As a result, the flexion of portion 130 decreases. Positioning the drive assembly to vary L, and the subsequent flexion of portion 130, enables a user to set the range of angles (variation in a radial direction) through which the nozzle changes as the drive assembly flexes tube 110 about the axis. Advantageously, the length of L is dynamically adjustable. That is, the drive assembly can be displaced to change L while tube 110 is being flexed and while the cleaning fluid is being sprayed from the nozzle at full flow and pressure.

More flexion results in a wider orbital pattern, while less flexion results in a smaller orbital pattern. Thus, advantageously, the ability to dynamically adjust L, and the subsequent dynamic control of the radial location and angle of the nozzle, results in the ability to adjust a cleaning pattern for assembly 100 from a very small, highly concentrated pattern (L is minimized) to a wider, lower concentrated pattern (L is maximized) during on-going cleaning operations. That is, a cleaning operation does not need to be halted to change the cleaning pattern.

For example, in FIG. 2A, when assembly 122 is rotating at a certain speed, portion 130 remains substantially in the position shown in the figure, that is, at distance RD and substantially parallel to axis 102, producing the smallest pattern. However, as the rotational speed of assembly 122 increases to a higher speed, portion 130 displaces as shown by the dashed lines such that radial distance RD1 of end 118 from axis 102 increases from RD. In addition, angle AG1, between portion 130, proximate end 118, and axis 102 increases. As a result, the radial extent of the spay pattern increases. As another example, in FIG. 2B, when assembly 122 is rotating at the higher speed, portion 130 displaces as shown by the dashed lines such that radial distance RD2 of end 118 from axis 102 increases from RD. In addition, angle AG2, between portion 130, proximate end 118, and axis 102 increases with respect to angle AG1. As a result, the radial extent of the spay pattern increases further.

Figure 4:
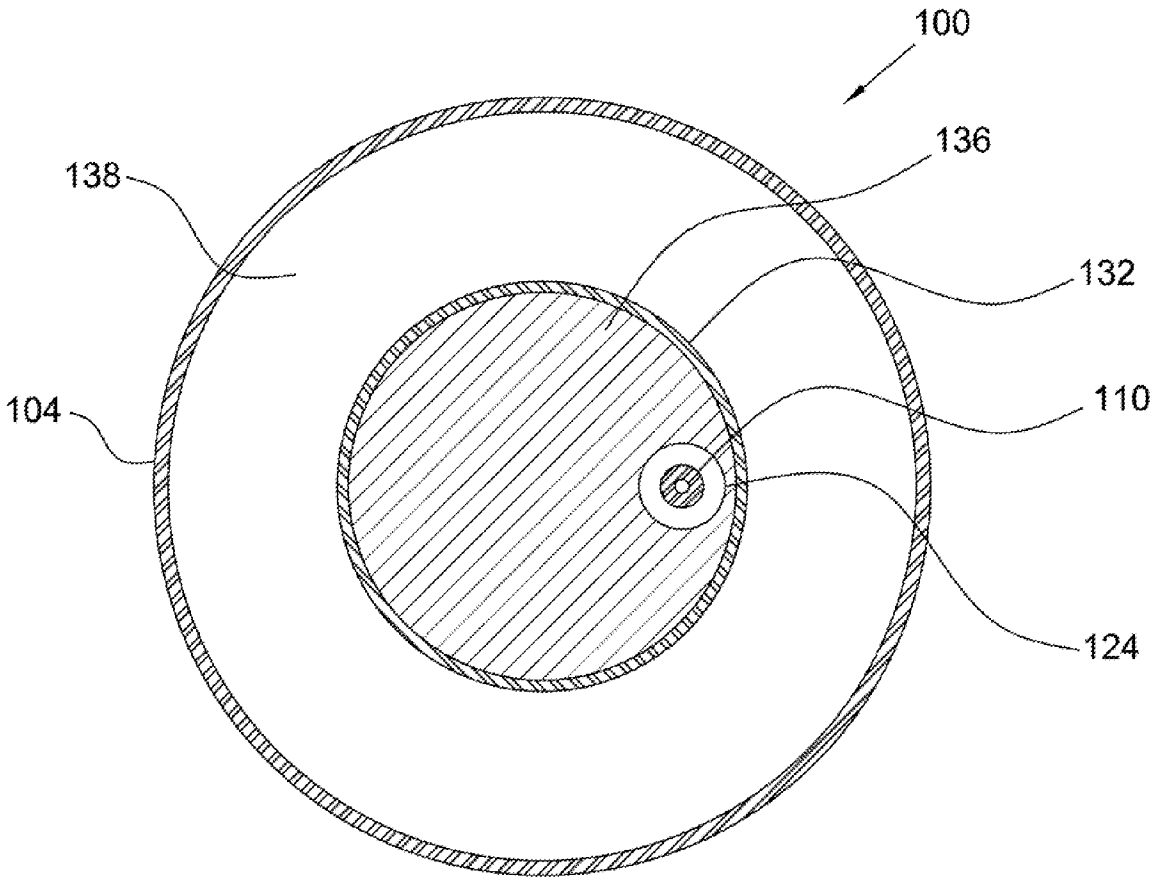
FIG. 4 is a cross-sectional view generally along line 4-4 in FIG. 2A.
Figure 5:
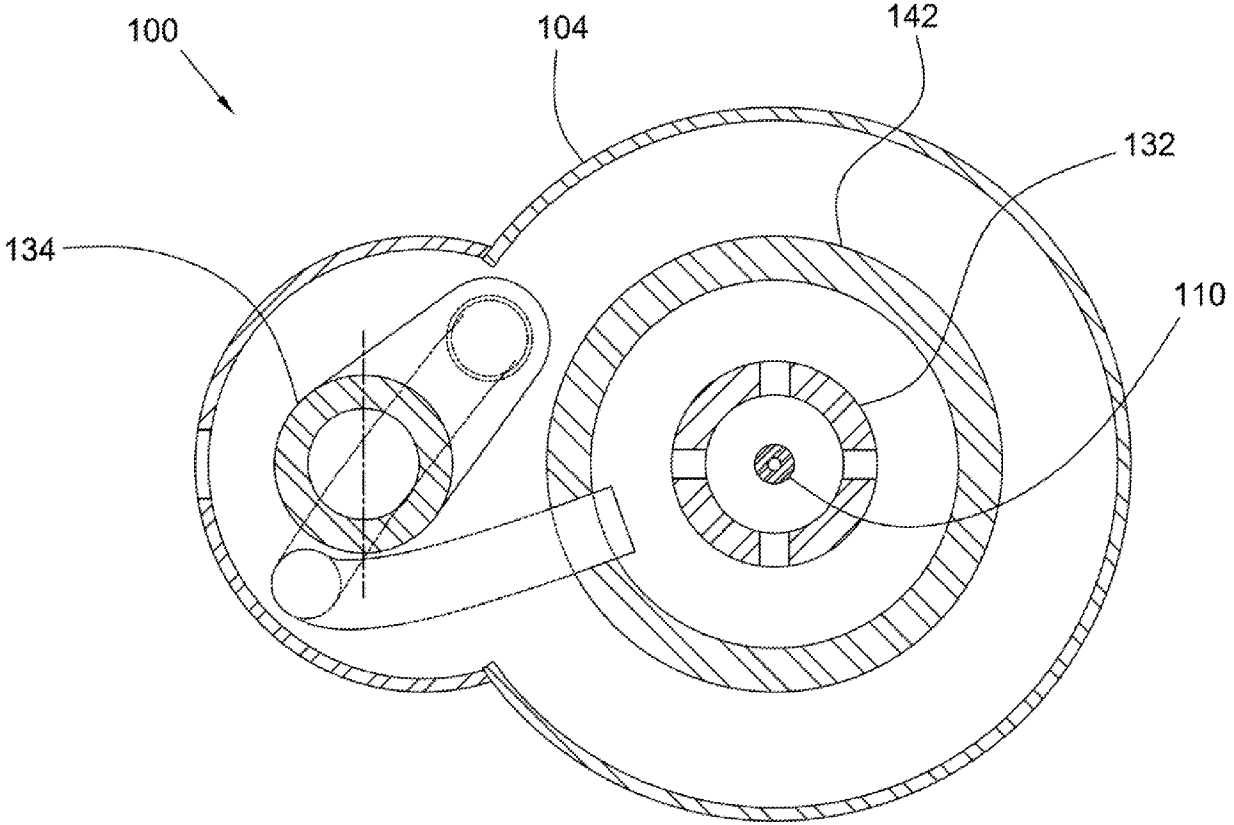
FIG. 5 is a cross-sectional view generally along line 5-5 in FIG. 2A; and, FIG. 6 is a cross-sectional view generally along line 6-6 in FIG. 2A.
Figure 6:
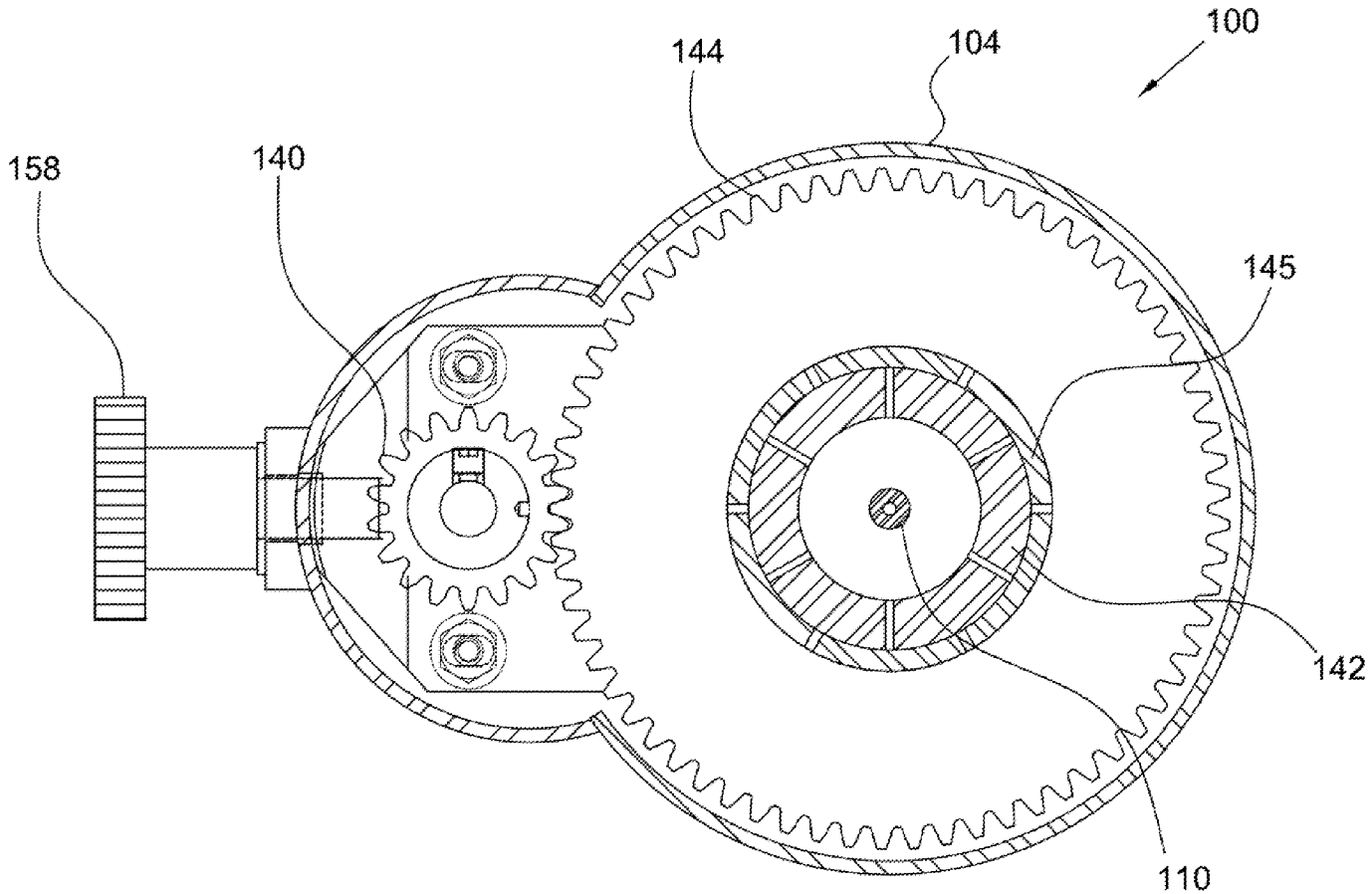

FIG. 4 is a cross-sectional view generally along line 4-4 in FIG. 2A. FIG. 5 is a cross-sectional view generally along line 5-5 in FIG. 2A. FIG. 6 is a cross-sectional view generally along line 6-6 in FIG. 2A. The following should be viewed in light of FIGS. 2A through 6. In an example embodiment, the drive assembly includes drive tube 132 connected to the deflector assembly and motor 134 arranged to rotate drive tube 132 and the deflector assembly about the axis of rotation. In an example embodiment, the deflector assembly includes bearing block 136 and deflector block 138. Through-bore 124 passes through the bearing and deflector blocks. Thus, bearing block 136 and/or deflector block 138 engages the tube to flex the tube as assembly 122 rotates about the axis. Motor 134 can be any motor known in the art. In an example embodiment, the motor is a pneumatic motor.

The following provides example details regarding assembly 100. In an example embodiment, the drive assembly includes gear 140, rotatable by the motor, drive tube 142, and gear 144 engaged with gear 140. In an example embodiment, gear 144 is connected to bushing assembly 145, which is connected to drive tube 142. Portion 146 of tube 110 is located within assembly 145. In an example embodiment, drive tubes 132 and 142 are integral, that is, formed as a single unit from a same piece of material. The motor is arranged to rotate drive tube 142 via gears 140 and 144. Swivel block 148 fits loosely on tube 110, enabling orientation of the tube to be independent of the orientation of housing 102, and enabling the housing to be oriented at will without putting torsion on the supply tube. In an example embodiment, the drive assembly includes frame 150 with slide blocks 152. The drive assembly is radially braced within the housing by the slide blocks and the slide blocks enable axial motion of the drive assembly within the housing, for example, as described above. Bearings 154 and 156 enable rotation of drive tube 142 with respect to the frame and the housing.

In an example embodiment, fastener 158, for example, a knurled thumb screw, is used to axially fix the frame to the drive assembly. The fastener passes through slot 160 in the housing. In an example embodiment, assembly 100 includes compression spring 162. Spring 162 absorbs variations in the reaction force from nozzle 120 and enables setting of the nozzle standoff distance by adjusting the position of outer shaft collar 164. Inner shaft collar 166 also is shown. Disassembly of the tube 110 from the housing 102 is therefore not required to set the standoff distance In an example embodiment, the fluid in source 114 is under pressure. The fluid is source 114 can be any cleaning fluid known in the art. In an example embodiment, the fluid is a liquefied inert gas, for example, nitrogen or argon. In an example embodiment, the fluid is water or a water-based solution.

Advantageously, orbiting the spray of a cleaning fluid results, as described for assembly 100, results in better cleaning in comparison to a stream of fluid from a non-orbital tube. Typically, cleaning fluids are pressurized so that more energy is stored in the fluid for cleaning purposes. Assembly 100 reduces the amount of energy that is wasted delivering the fluid for cleaning operations. For example, it is desirable to use as few nozzles as possible because a significant amount of energy is dissipated at a nozzle due to friction. However, using only a single type nozzle typically results in a non-adjustable spray pattern with insufficient coverage. By creating orbital motion and flexion of a single nozzle, as disclosed herein, a single nozzle can be used to reduce frictional energy losses associated with tight swivel seals, for example, as taught by Hume, while maintaining a sufficiently large and dynamically adjustable spray coverage. For example, the positioning of assembly 122 and the flexing of end 118 in a radial direction controls a radial extent of a spray pattern for nozzle 120.

Thus, it is seen that the objects of the present invention are efficiently obtained, although modifications and changes to the invention should be readily apparent to those having ordinary skill in the art, which modifications are intended to be within the spirit and scope of the invention as claimed. It also is understood that the foregoing description is illustrative of the present invention and should not be considered as limiting. Therefore, other embodiments of the present invention are possible without departing from the spirit and scope of the present invention.

What we claim is:

1. An orbital cleaning assembly, comprising:
an axis of rotation;
a housing;
a drive assembly at least partly disposed within a space formed by the housing;
a tube assembly at least partly disposed within the space and including:
a tube including:
a first end arranged to connect to a source of fluid; and,
a flexible portion including a second end of the tube, the second end arranged to receive a nozzle, wherein the drive assembly is arranged to:
position the second end of the tube at a radial distance from the axis of rotation; and,
flex the tube assembly such that the second end traverses a path about the axis, wherein:
the drive assembly includes a deflector assembly with a through-bore;
a first portion of the tube is disposed within the through-bore;
a second portion of the tube is unsupported from the deflector assembly to the second end of the tube; and,
the drive assembly is axially displaceable within the housing such that:
as the drive assembly displaces toward the first end of the tube, an axial length of the second portion increases and flexibility of the second portion increases; and,
as the drive assembly displaces toward the second end of the tube, the axial length of the second portion decreases and the flexibility of the second portion decreases.

2. The orbital cleaning assembly of claim 1, wherein the first end of the tube is rotationally fixed with respect to the axis of rotation.

3. The orbital cleaning assembly of claim 1, wherein:
the drive assembly includes a deflector assembly with a through-bore;
a portion of the tube is disposed within the through-bore;
the through-bore constrains the tube such that the second end of the tube is at the radial distance; and,
the deflector assembly is arranged to rotate to flex the second end of the tube about the axis.

4. The orbital cleaning assembly of claim 1, wherein:
the deflector assembly is arranged to rotate to flex the second end of the tube about the axis;
as the drive assembly displaces toward the first end of the tube, an ability of the second end of the tube to resist radially outward movement in response to rotation of the deflector assembly decreases; and,
as the drive assembly displaces toward the second end of the tube, an ability of the second end of the tube to resist radially outward movement in response to rotation of the deflector assembly increases.

5. The orbital cleaning assembly of claim 1, wherein:
the drive assembly is axially displaceable while the tube is rotating; or,
the drive assembly is axially displaceable while fluid is being sprayed from a nozzle.

6. The orbital cleaning assembly of claim 1, wherein:
the drive assembly includes a deflector assembly with a through-bore;
a portion of the tube is disposed within the through-bore;
the first end of the tube is axially fixed with respect to the housing; and,
the drive assembly is axially displaceable within the housing such that as the drive assembly axially displaces, an axial position of the deflector assembly with respect to the tube changes.

7. The orbital cleaning assembly of claim 1, wherein:
the drive assembly includes a deflector assembly with a through-bore;
the tube passes through the through-bore;
the drive assembly includes:
a first drive tube connected to the deflector assembly; and, a motor arranged to rotate the first drive tube and the deflector assembly about the axis of rotation; and, the deflector assembly is arranged to engage the tube to flex the second end of the tube about the axis of rotation.

8. The orbital cleaning assembly of claim 7, wherein:

the drive assembly includes:

a first gear rotatable by the motor;

a second drive tube; and, a second gear engaged with the first gear;

the motor is arranged to rotate the second drive tube via the first and second gears; and, the second drive tube is rotationally fixed with respect to the first drive tube.

9. The orbital cleaning assembly of claim 8, wherein the flexible portion of the tube is at least partly disposed in the first drive tube.

10. The orbital cleaning assembly of claim 1, wherein fluid is selected from the group consisting of a liquefied inert gas, water, and a water-based solution.

11. An orbital cleaning assembly, comprising:

an axis of rotation;

a housing;

a drive assembly at least partly disposed within the housing and including a motor and a deflector assembly with a through-bore; and, a tube assembly at least partly disposed within the housing and including:

a tube with:

a first end arranged to connect to a source of fluid;

a flexible portion passing through the through-bore;

a second end arranged to receive a nozzle; and, a portion between the second end and the deflector assembly, wherein:

the deflector assembly is arranged to position the portion of the tube at a radial distance from the axis of rotation;

the motor is arranged to rotate the deflector assembly such that the second end traverses a path about the axis;

the first end of the tube is rotationally fixed with respect to the axis of rotation; and, the drive assembly is axially displaceable within the housing such that:

as the drive assembly displaces toward the first end of the tube, an axial length of the portion of the tube increases and flexibility of the portion, in a radially outward direction, increases; and, as the drive assembly displaces toward the second end of the tube, the axial length of the portion decreases and the flexibility of the portion decreases.

12. An orbital cleaning assembly, comprising:

an axis of rotation;

a housing;

a drive assembly at least partly disposed within a space formed by the housing;

a tube assembly at least partly disposed within the space and including:

a tube including:

a first end arranged to connect to a source of fluid; and, a flexible portion including a second end of the tube, the second end arranged to receive a nozzle, wherein the drive assembly is arranged to:

position the second end of the tube at a radial distance from the axis of rotation; and, flex the tube assembly such that the second end traverses a path about the axis, wherein:

the drive assembly includes a deflector assembly with a through-bore;

a portion of the tube is disposed within the through-bore;

the first end of the tube is axially fixed with respect to the housing; and, the drive assembly is axially displaceable within the housing such that as the drive assembly axially displaces, an axial position of the deflector assembly with respect to the tube changes; or, wherein:

the drive assembly includes a deflector assembly with a through-bore;

the tube passes through the through-bore;

the drive assembly includes:

a first drive tube connected to the deflector assembly; and, a motor arranged to rotate the first drive tube and the deflector assembly about the axis of rotation; and, the deflector assembly is arranged to engage the tube to flex the second end of the tube about the axis of rotation.

* * * * *